US006751328B1

(12) United States Patent
Lin

(10) Patent No.: US 6,751,328 B1
(45) Date of Patent: Jun. 15, 2004

(54) EARPHONE WITHOUT IMPULSE NOISE FOR PROTECTION AGAINST CONDUCTIVE HEARING LOSS

(76) Inventor: Chung-Yu Lin, 29, Tunnel 152, Kuang Hwa 1 Rd., Kaohsiung (TW)

( * ) Notice: Subject to any disclaimer, the term of this patent is extended or adjusted under 35 U.S.C. 154(b) by 0 days.

(21) Appl. No.: 09/227,929

(22) Filed: Jan. 8, 1999

(30) Foreign Application Priority Data

Jan. 13, 1998 (TW) ..... 87100395 A

(51) Int. Cl.[7] ..... H04R 25/00
(52) U.S. Cl. ..... 381/330; 381/322
(58) Field of Search ..... 381/312, 328, 381/330, 72, 313, 317, 322, 326

(56) References Cited

U.S. PATENT DOCUMENTS 5,664,014 A * 9/1997 Yamaguchi ..... 381/328
5,812,659 A * 9/1998 Mauney ..... 381/328
5,949,896 A * 9/1999 Nageno ..... 381/328

* cited by examiner

*Primary Examiner*—Minsun Oh Harvey
(74) *Attorney, Agent, or Firm*—Raymond Y. Chan; David and Raymond Patent Group

(57) ABSTRACT

An earphone without impulse noise for protection against conductive hearing loss includes an earphone housing and a loudspeaker mounted in a sound chamber therein. A front end of the earphone housing has an earplug adapted to be hanged between the tragus and the antitragus of the external ear while a rear end thereof has a hood with a hollow sound chamber. A loudspeaker is supported in the hollow sound chamber of the hood around which a plurality of sound holes are distributed, wherein a sound output end of the loudspeaker must be positioned facing to the hood and opposite to the earplug. A conductive cord is connected at the bottom end of the earphone housing for transmitting electric current to the loudspeaker.

5 Claims, 3 Drawing Sheets

EARPHONE WITHOUT IMPULSE NOISE FOR PROTECTION AGAINST CONDUCTIVE HEARING LOSS

FIELD OF THE INVENTION

The present invention relates to an earphone without impulse noise for protection against conductive hearing loss, which can prevent the sound waves direction of loudspeaker thereof is not directly transmitted to the tympanic membrane located in the most inner side of external auditory canal. The middle ear can be protected against conductive hearing loss caused by the direct impact of the sound pressure.

BACKGROUND OF THE INVENTION

It is conventionally know that the sound is defined as a physical energy and is transmitted in the form of energy. The farther the sound travels the greater energy it contains (like thunder or sound from gunshots). Therefore, energy in the sound is measured by the logarithm system while decibel(s) is often used as the unit to measure the sound intensity. However, the "decibel" is not an absolute value, but a relative value, such that the decibel means a comparison of the intensity between two sounds. Hence, if we say how many decibels a sound has, it means that how many times its pressure greater than a certain reference one. When an audiometer is used to measure the hearing and the decibels increase from 0 to 60, it is indicated that the energy in the sound increases by $10^6$. However, even a sound pressure with 60 decibels isn't a loud sound, and it's nearly equal to a great sound a few feet away from us in our daily life.

A human ear, as shown in FIGS. 1 to 3, consists of three main parts—the external ear 10, the middle ear 20, and the inner ear 30. The external ear 10 includes the helix 11, the antihelix 12, the auricle 13, the concha 14, the antitragus 15, the tragus 16, and the external auditory canal 17 whose length of an adult is about 24 mm. The tympanic membrane 171 is located in the most inner side of the external auditory canal 17. The external auditory canal 17 and the middle ear 20 are separated by the tympanic membrane 171 while the middle ear 20 is the ear drum formed between the external ear 10 and the inner ear 30 and having the malleus 21, the incus 22 and the stapes 23, wherein the end of the malleus 21 lies hidden in the tympanic membrane 171 while the body of the malleus 21 and the head of the incus 22 are joined together to be a joint. Besides, the incus 22 has a short leg 221 and a long leg 222, wherein the short leg 221 leans on the wall of the ear drum while the end of the long leg 222 is linked to the head of the stapes 23. The end of the stapes 23 is formed as a foot shape, as shown in FIG. 2.

Moreover, the inner ear 30 includes the cochlea 31 and the labyrinth 32, wherein the cochlea 31 controls the human hearing system while the labyrinth 32 maintains balance in the body. These two fine parts are enclosed by a capsule; in addition, some perilymphs in the most outer layer thereof cover the cochlea 31 and the labyrinth 32. These perilymphs are functioned as an air cushion to provide an excellent protection when the head gets an intense vibration. In fact, the cochlea 31 and the labyrinth 32 are floating in the fluid of the lymphs. The inside of the cochlea 31 consists of three parts—the scala vestibuli, the scala tympani, and the cochlear duct containing perilymph. The nerve cells in the cochlea 31 contain about 30,000 hairlike nerve endings. Besides, the oval window 33 and the round window 34 are located near the wall surface of eardrum of the middle ear 20 while the base of the stapes rests against the opening of oval window 33 and the inner side thereof is attached to the scala vestibuli 311 of the cochlea 31 so that the cochlea 31 can receive the sound pressure transmitted from the auditory ossicies while the round window 34 is attached to the scala tympani 312 of the cochlea 31 in order to directly receive the sound transmitted from the eardrum of the middle ear 20.

Furthermore, after the sound pressure is transmitted from the tragus 17 to the tympanic membrane 171, a portion of the sound pressure is partially reflected back to the tragus 76 while another portion of the sound pressure passes through the tympanic membrane 171 into the middle ear 20. The portion of the sound pressure that has been transmitted into the middle ear 20 has a certain part pass through the malleus 21 and the incus 22 into the foot-shaped end of the stapes 23 (those who consist of the malleus 21, the incus 22, and the stapes 23 is hereafter called auditory ossicles), and then through the oval window 33 into the cochlea 31 of the inner ear 30. The rest of the sound pressure is transmitted by the air medium in the eardrum into the cochlea 31 of the inner ear 30.

Consequently, the sound pressure transmitted into the human ear is divided into two parts to enter the inner ear 30; however, the sound transmitted by the way of auditory ossicles into the oval window 33 is more effective and important than that transmitted by the air medium through eardrum into the round window 34. The reason is that 99.9% of the energy of the sound pressure transmitted into the eardrum of the middle ear 20 and passing by way of the air medium through the round window 34 into the perilymph of the cochlea 31 is consumed or reflected back by the fluid surface. Only 0.1% of the energy is able to pass through the perilymph into the cochlea 31.

Accordingly, the most effective way of the sound transmission is carried out from the tympanic membrane 171 through the auditory ossicles into the oval window 33. However, when the sound pressure is transmitted to the end of the stapes 23 and strikes the oval window 33, it directly passes through the incompressible perilymph into the cochlea 31 while the sound pressure is not consumed or reflected by the fluid surface. Presently, the perilymph containing the sound pressure stimulates the hairlike nerve endings in the cochlea 31 to generate a displacement or a bending, and this motion can turn the mechanical force in the sound pressure into electrochemical impulses that are carried up the acoustic nerve to auditory cortex of the brain. At last, it is the sound we can understand.

In view of the above, we realize that sense of hearing of the human ear is generated by the movement of the hairlike nerve endings, that even a slight displacement of the hairlike nerve endings causes the sense of hearing. Therefore, the sense of the human ear is very sharp and the perceptible pitch is also very wide. Generally, the perceptible frequency range of human beings is about 20~20000 Hz while the intensity range $10^{12}$~$10^2$ W/m$^2$ and the sound pressure less than 180 dB. However, not all perceptible sounds are suitable for the human ear to receive. The pitch in the improper range (sound pressure over 90 dB is so-called noise) easily causes the damage of the auditory part in the ear. The factory workers under a long-time exposure to the industrial noise without wearing any hearing protectors (like earplug or earphone) have the hearing damage possibility up to 25% after a few years.

The reason lies in that the sound pressure of the industrial noise stimulates the hairlike nerve endings in the ear to generate a displacement or a bending. They return to the original state when leaving this noise circumstance for a period. The restoring effect of the hairlike nerve endings worsens more and more with the time and causes the hearing damage in the inner ear. This kind of hearing loss mostly belongs to the perceptive hearing threshold while the other kind is mostly caused by a direct strike on the head or an instant impulse noise, resulting in a damage of the ear membrane or the auditory ossicles so that the sound pressure transmitted in the middle ear 20 simultaneously enters the oval window 33 and the round window 34 in the vestibuli 33 and it is counteracted by each other. Accordingly, a hearing loss is caused. This kind of conductive function loss in the middle ear is called conductive hearing loss.

Obviously, the hearing loss resulting from the above mentioned kind of conductive function loss in the middle ear increases in these years, and most of them are the young people using Walkman. It is well-known that the loudspeaker of the common stereophonic sound or the earphone is driven by the current connected by the electric cord so that the conic paper box on the front part and the vibrating membrane generate a to and fro vibration to produce sound and music. A complicate physical phenomenon is produced by this simple, to and fro repetitive movement that the air is compressed when the conic paper box on the front part and the vibrating membrane move forward so that the molecules in the air become dense to be the high pressure air while the molecules in the air are thinned to be the low pressure air when the conic paper box on the front part and the vibrating membrane move backward.

However, the air molecules have the same characteristics as we don't like to be compressed and squeezed, so that an elasticity is generated by the squeezed air to push the energy produced by the loudspeaker to a farther place. When the loudspeaker proceeds with the to and fro movement, the adjacent air pushes the energy forward by this loudspeaker. This energy pushing the sound transmission is called "sound pressure".

Accordingly, the sound energy transmission is a continual connection between a high pressure space and a low pressure space. This pressure space as the wave includes the wave peak and the wave valley which move forward unceasingly, so that the moving direction of the sound produced by the loudspeaker is completely driven by the sound pressure and the people in the farther place is also able to hear the sound or music produced by the loudspeaker.

Furthermore, the transmission way and the distribution state of the sound produced by the loudspeaker depend on the frequency of the loudspeaker. For example, the low tone of sound itself has no direction. When it sounds, it is slowly propagated to all directions. Therefore, the furnishing place for the super low tone is not so demanding as the common loudspeaker while the propagation way of the high tone of sound is similar to laser rays whose proceeding direction is almost straight, so that surfaces resulting in reflection should be prevented for the furnishing direction of the high tone body from the counteraction of tone quality and the destruction of the sound field. In other words, the sound pressure is the same in all of the propagation directions when the loudspeaker sounds. However, the front direction of the loudspeaker must face the continual double impact of the sound pressure and the high tone. Thus, a strong feeling and an obvious vibration are produced when we are hearing the Rock & Roll of the heavy metal music or fast rhythm music.

The loudspeaker makes use of the vibration to propagate the converted sound or music signal to a space to form a sound field. So, we have a strong vibration feeling when we get a strong sound pressure in a sound field; we don't have a strong feeling when we are in a slight sound pressure. However, we are still within the vibration range of the sound field. So, we receive impact vibrations of the sound pressure when we are in the sound field, no matter which music or sound is played, even the small loudspeaker installed in the earphone has its own sound field range. The difference only lies in the different intensity.

The conventional earphone has two types. One is the earplug type and the other is earmuff type. Whichever earphone is used, its loudspeaker is placed near the outer opening of the external auditory canal while the right side of the loudspeaker is opposite to the tympanic membrane inside the external auditory canal of the ear so as to enable the ear to directly receive sound or music from the loudspeaker. Though an excellent tone quality is able to be received by the ear through this way due to the fact that the ear is within the sound field range of the loudspeaker and the sound pressure is vibrating between the loudspeaker and ear membrane. Moreover, the sound pressure from the earphone is about 10 dB higher than that from the common loudspeaker with respect to the same sound received by the ear. In addition, the sound pressure generated by the earphone of the Walkman is always over 90 dB; therefore the conductive function loss of the middle ear or the hearing loss is easily caused by such strong sound pressure and the unceasing impact noise.

SUMMARY OF THE INVENTION

The applicant is a licensed doctor having clinic experiences for years. Since patients with hearing loss seeking medical counsel are more and more young people and the applicant found that the reason for that lies in the use of the Walkman resulting in the damage of conductive function in the middle ear. Besides, the impulse noise is the main reason for the damage of the tympanic membrane and the auditory ossicles.

Accordingly, it is a main object of the present invention to provide an earphone by which the splendid music is able to be heard as by the conventional earphone and the conductive function of middle ear is protected against damage resulting from impulse noise.

It is another object of the present invention to provide an earphone without impulse noise for protection against conductive hearing loss, in which both the sound emitted by the loudspeaker in the earphone and the sound outsides can be caught by the ear, so that any events outside can be realized at once without taking off the earphone.

DETAILED DESCRIPTION OF THE PREFERRED EMBODIMENTS

Figure 1:
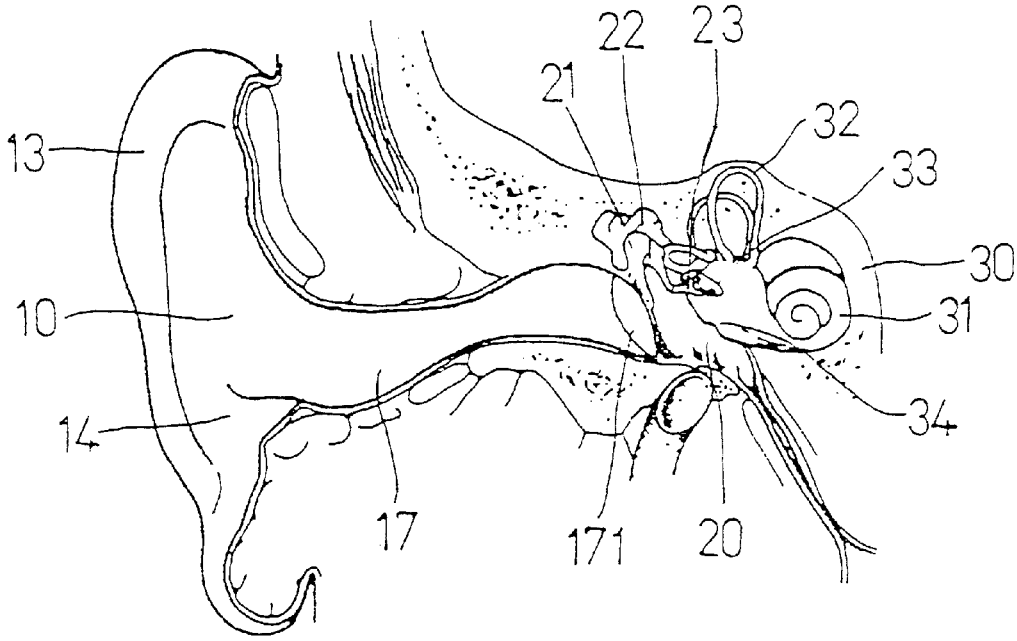
FIG. 1 is a cross-sectional view of the human ear.
Figure 2:
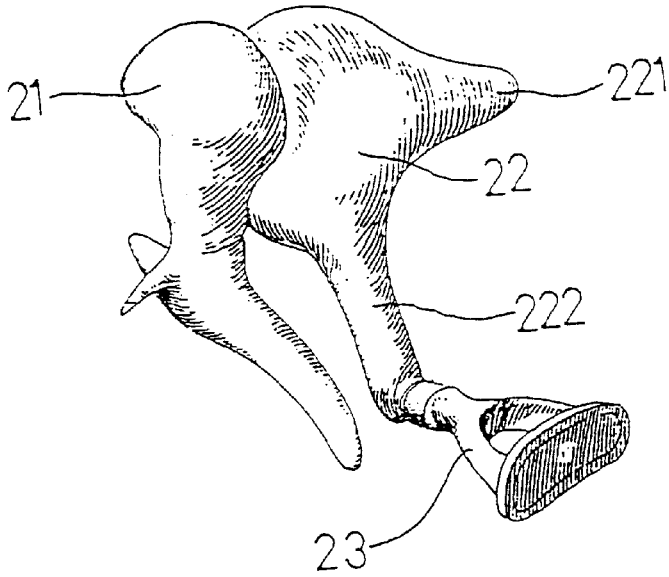
FIG. 2 is an assembly view of the malleus, the incus, and stapes of the middle ear.
Figure 3:
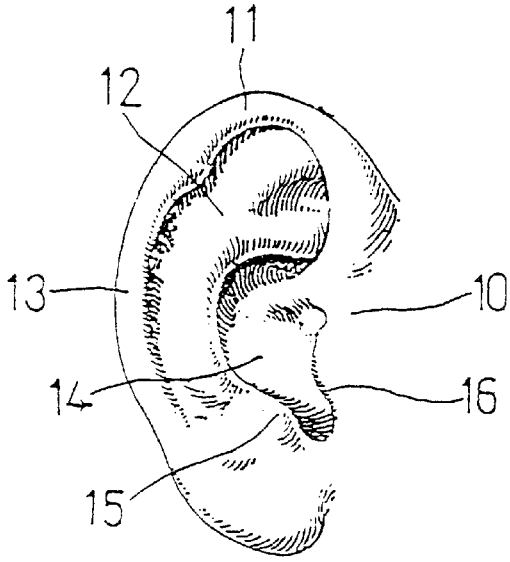
FIG. 3 is a perspective view of the external ear.
Figure 4:
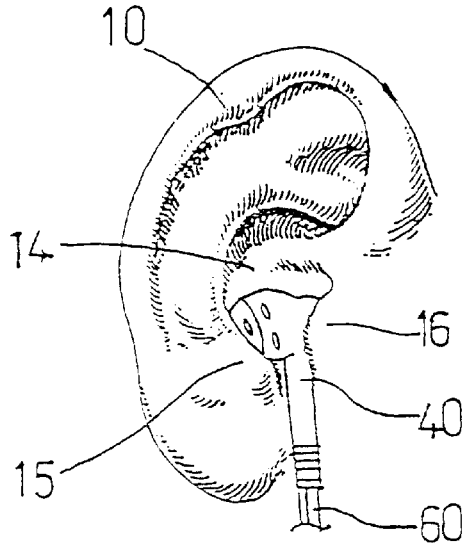
FIG. 4 is a perspective view of the present invention hanged between the tragus and antitragus.
Figure 5:
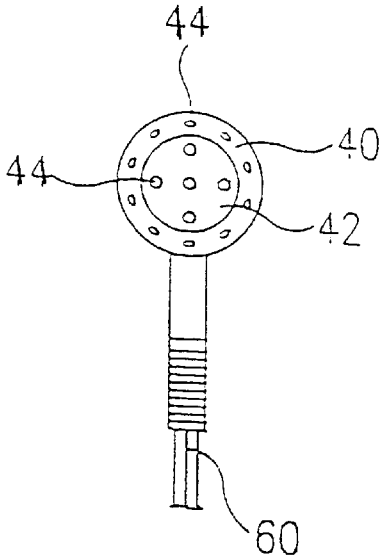
FIG. 5 is an elevation view of an earphone according to a preferred embodiment of the present invention.
Figure 6:
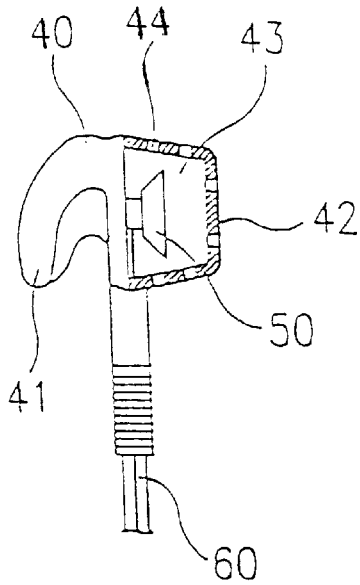
FIG. 6 is a partially sectional view of the earphone according to the above preferred embodiment of the present invention.

Referring to FIGS. 4 to 6, an earphone without impulse noise for protection against conductive hearing loss in accordance with a first preferred embodiment of the present invention comprises an earphone housing 40, a loudspeaker 50 mounted inside the earphone housing 40, and a conductive cord 60 connected to the loudspeaker 50.

A front portion of the earphone housing 40 provides an earplug 41 adapted to be hanged between the tragus 16 and the antitragus 15 of the external ear 10. A rear portion of the earphone housing 40 has a hood 42, which defines a hollow sound chamber 43 therein. The conductive cord 60 is connected at a bottom end of the earphone housing 40 for transmitting electric current to the loudspeaker 50. A plurality of sound holes 44 are spacedly distributed on the hood 42 to enable the outside sound entering the earphone housing 40 therethrough.

The loudspeaker 50 is supported in the hollow sound chamber 43 of the hood 42. The loudspeaker 50 has a sound output end facing to the hood 42, i.e. rear portion of the earphone housing 40, while another back end of the loudspeaker 50 facing to the earplug 41 of the earphone housing 40. In other words, the sound output end of the loudspeaker 50 must be arranged opposite to the back of the earplug of the earphone housing 40.

As mentioned above, the earphone housing 40 is worn on the user's ear by handing the earplug 41 between the tragus 16 and the antitragus 15 of the external ear 10, wherein the hood 42 of the earphone housing 40 is exposed outside the external auditory canal 17. In view of above, it is realized that when the loudspeaker 50 inside the earphone housing 40 emits sound through the sound holes 44 against the antitragus 15, the sound pressure is absorbed and rebounded by the antitragus 15, so that the whole ear is situated in the range of the sound field of the loudspeaker 50. Accordingly, the tone quality received from the earphone of the present invention is the same as from the conventional earphone; however, the sound pressure does not directly impact upon the tympanic membrane 171 of the external auditory canal 17 while the instant impulse noise emitted in the process of playing music can be avoided, so that the conductive function of the middle ear 20 won't be damaged to influence the conductive hearing.

Figure 7:
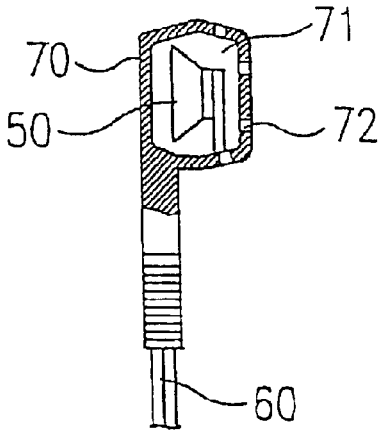
FIG. 7 is a cross-sectional view of the housing of an earphone according to a second preferred embodiment of the present invention.

FIG. 7 illustrates a second preferred embodiment of an earphone without impulse noise for protection against conductive hearing loss in accordance with the present invention, which also comprises an earphone housing 70 and a loudspeaker 50 installed therein. A front portion of the earphone housing 70 is arranged to be hanged between the tragus 16 and the antitragus 15 of the ear and attached on the concha 14. The earphone housing 70 has a hollow sound chamber 71 therein for receiving and holding the loudspeaker 50. A plurality of sound holes 72 are distributed on the surface around the front portion of the earphone housing and a conductive cord 60 is connected at the bottom end for transmitting electric current to the loudspeaker 50. The loudspeaker 70 also has a sound output end arranged facing to a back end of the earphone housing.

As shown in FIG. 7 of the second preferred embodiment, when the loudspeaker 50 in the earphone housing 70 sounds, the sound pressure is emitted towards the back wall of the earphone housing 70 and rebounded by the inner wall of the back end of the earphone housing 70, so that the whole ear is situated within the sound field of the loudspeaker 50. Therefore, the tone quality received is the same to by the conventional earphone; however, the sound pressure won't have direct impact upon the tympanic membrane 171 of the external auditory canal 17 while the instant impulse noise emitted in the process of playing music can be avoided, so that the conductive function of the middle ear 20 won't be damaged to influence the conductive hearing.

Figure 9:
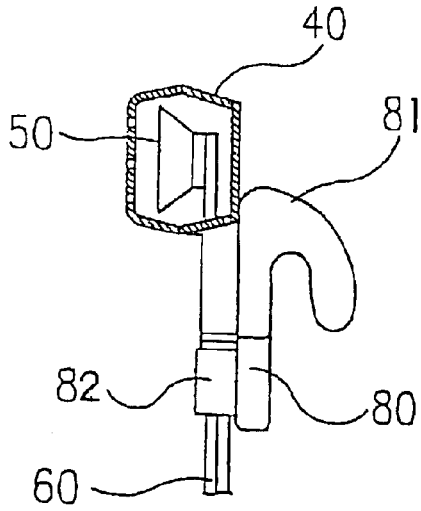
FIG. 9 is a schematic view of the earphone connected with the earplug mounting ring according to the above second embodiment of the present invention.
Figure 8B:
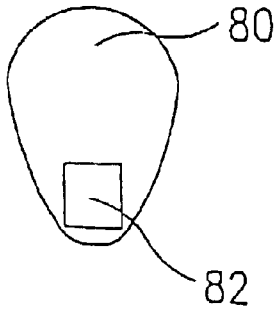
FIGS. 8A to 8C are the front, rear and side views of the earplug mounting ring according to the above second embodiment of the present invention.
Figure 8C:
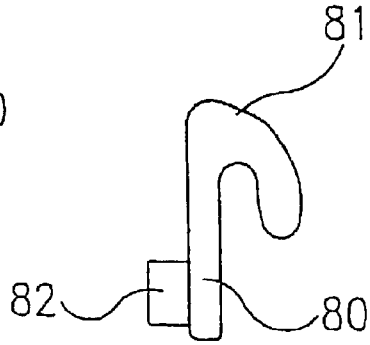
Figure 8A:
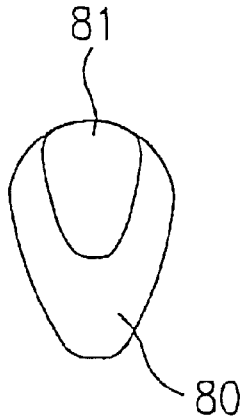

As shown in FIG. 8 and 9, a third preferred embodiment of the present invention is illustrated, which is an alternative mode of the above first preferred embodiment that the earplug 41 in the first embodiment is constructed as an independent component in this third embodiment, wherein an earplug body 80 is installed at a bottom end of the earphone housing 40. The earplug body 80 provides a plug hook 81 extending downwardly from an upper portion thereof adapted to be hanged between the tragus 16 and the antitragus 15, and a ring seat 82 connected to a lower end thereof for mounting the earplug body 80 to a rear end of the earphone housing 40. Also, the earphone housing 40 can adjust its position upwards or downwards with respect to the ring seat 82 in order to fit the ear size of the user.

Concluded from the above, the present invention includes the following advantages:

1. With respect to sound with the same frequency, the sound pressure on the human ear can be reduced to the lowest extent while the same tone quality to that of the conventional earphone is achievable.
2. The external auditory canal of the human ear can be protected against the collision of the impact noise so that the damage of the transmission function in the middle ear can thus be avoided. Therefore, a conductive hearing loss won't happen to the people loving to wear earphone for a long period.
3. By using the present invention, both the sound emitted by the loudspeaker in the earphone and the sound outsides can be caught by the ear so that any events outside are able to be realized at once to take any proper action.

What is claimed is:

1. An earphone without impulse noise for protection against conductive hearing loss, comprising:

an earphone housing comprising an earplug, which is adapted for being hanged between a tragus and an antitragus of an external ear, and a hood, which is a rear portion of said earphone housing, wherein a hollow sound chamber is defined in said hood and a plurality of sound holes are spacedly distributed on said hood for outside sound entering said hollow sound chamber of said earphone housing;

a loudspeaker, which is supported in said hollow sound chamber of said hood, having a sound output end facing to said hood of said earphone housing and a back end facing to said earplug, wherein said sound output end of said loudspeaker is arranged opposite to said earplug; and a conductive cord which is connected at a bottom end of said earphone housing for transmitting electric current to said loudspeaker.

2. The earphone as recited in claim 1 wherein said earplug is integrally formed at a front portion of said earphone housing.

3. The earphone as recited in claim 1 wherein said earplug comprises an independent earplug body which is installed at said bottom end of said earphone housing.

4. The earphone as recited in claim 3 wherein said earplug body provides a plug hook extending downwardly from an upper portion thereof adapted to be hanged between said tragus and said antitragus, and a ring seat connected to a lower end thereof for mounting said earplug body to a rear end of said earphone housing, wherein said earphone housing is capable of adjusting a position thereof upwards or downwards with respect to said ring seat.

5. An earphone without impulse noise for protection against conductive hearing loss, comprising:

an earphone housing having a rear portion, a front portion arranged for being hanged between a tragus and an antitragus of an external ear and attached on a concha, a hollow sound chamber defined therein, and a plurality of sound holes distributed on said front portion of said earphone housing;

a loudspeaker, which is supported in said hollow sound chamber of said earphone housing, having a sound output end arranged facing to said rear portion of said earphone housing, and a back end facing to said front portion of said earphone housing, wherein said sound output end of said loudspeaker is arranged opposite to said front portion of said earphone housing; and a conductive cord which is connected at a bottom end of said earphone housing for transmitting electric current to said loudspeaker.

* * * * *